US010950930B2

(12) United States Patent
Sampo

(10) Patent No.: US 10,950,930 B2
(45) Date of Patent: Mar. 16, 2021

(54) ANTENNA DEVICE

(71) Applicant: YOKOWO CO., LTD., Tokyo (JP)

(72) Inventor: Takeshi Sampo, Gunma (JP)

(73) Assignee: YOKOWO CO., LTD., Tokyo (JP)

( * ) Notice: Subject to any disclaimer, the term of this patent is extended or adjusted under 35 U.S.C. 154(b) by 0 days.

(21) Appl. No.: 16/347,594

(22) PCT Filed: Nov. 8, 2017

(86) PCT No.: PCT/JP2017/040301
§ 371 (c)(1),
(2) Date: May 6, 2019

(87) PCT Pub. No.: WO2018/110162
PCT Pub. Date: Jun. 21, 2018

(65) Prior Publication Data

US 2019/0267706 A1 Aug. 29, 2019

(30) Foreign Application Priority Data

Dec. 16, 2016 (JP) ..... JP2016-244805

(51) Int. Cl.
*H01Q 1/48* (2006.01)
*H01Q 9/42* (2006.01)
*H01Q 9/30* (2006.01)

(52) U.S. Cl.
CPC ..... *H01Q 1/48* (2013.01); *H01Q 9/30* (2013.01); *H01Q 9/42* (2013.01)

(58) Field of Classification Search
CPC .. H01Q 1/48; H01Q 9/30; H01Q 9/42; H01Q 9/44
See application file for complete search history.

(56) References Cited

U.S. PATENT DOCUMENTS

2005/0153756 A1 7/2005 Sato et al.
2010/0194658 A1 8/2010 Yukimoto et al.
(Continued)

FOREIGN PATENT DOCUMENTS

CN 2738415 Y 11/2005
CN 101689707 A 3/2010
(Continued)

OTHER PUBLICATIONS

International Search Report and Written Opinion dated Jan. 30, 2018 for PCT/JP2017/040301 filed on Nov. 8, 2011, 7 pages including translation of the International Search Report.
(Continued)

*Primary Examiner* — Raymond R Chai
(74) *Attorney, Agent, or Firm* — Xsensus LLP

(57) ABSTRACT

An antenna device has a configuration in which a feeding point is located at a position that is distant from an outer periphery of a ground conductor plate to a center side and that would correspond to polarized waves parallel to the ground conductor plate. The antenna devices includes a ground conductor plate and an antenna element. The antenna element includes a first vertical portion and a second vertical portion which are erected substantially perpendicularly from the ground conductor plate and a first parallel portion, a second parallel portion, and a third parallel portion which extend substantially parallel to the ground conductor plate. An end portion, in the −Z direction, of the first vertical portion serves as a feeding point and is located at a position that is distant from an outer periphery of the ground conductor plate to a center side.

18 Claims, 4 Drawing Sheets

1 ANTENNA DEVICE

1 ANTENNA DEVICE

(56) References Cited

U.S. PATENT DOCUMENTS

| | | | | |
|---|---|---|---|---|
| 2013/0120215 | A1* | 5/2013 | Shih | H01Q 1/243<br>343/848 |
| 2014/0009343 | A1* | 1/2014 | Iellici | H01Q 21/24<br>343/700 MS |
| 2015/0048995 | A1* | 2/2015 | Andrenko | H01Q 9/42<br>343/893 |
| 2019/0288399 | A1* | 9/2019 | Tanaka | H01Q 1/36 |
| 2020/0286070 | A1* | 9/2020 | Garrett | G06Q 20/229 |

FOREIGN PATENT DOCUMENTS

| | | | | |
|---|---|---|---|---|
| CN | 203339292 | U | 12/2013 | |
| JP | 2006-140667 | A | 6/2006 | |
| JP | 2007-049249 | A | 2/2007 | |
| JP | 2007-124016 | A | 5/2007 | |
| WO | WO-2008023800 | A1 * | 2/2008 | H01Q 5/385 |

OTHER PUBLICATIONS

Extended European Search Report dated Jul. 1, 2020 in European Patent Application No. 17880611.3, 8 pages.
Office Action dated Mar. 18, 2020 in Chinese Patent Application No. 201780071891.1, 19 pages.

* cited by examiner

1 ANTENNA DEVICE

1 ANTENNA DEVICE

COMPARATIVE EXAMPLE

800 ANTENNA DEVICE

COMPARATIVE EXAMPLE

800 ANTENNA DEVICE

2 ANTENNA DEVICE

2 ANTENNA DEVICE

ANTENNA DEVICE

CROSS-REFERENCE TO RELATED APPLICATIONS

The present application is based on PCT filing PCT/JP2017/040301, filed Nov. 8, 2017 which claims priority to JP 2016-244805, filed Dec. 16, 2016, the entire contents of each are incorporated herein by reference.

TECHNICAL FIELD

The present invention relates to an antenna device having a feeding point at a position that is distant from an outer periphery of a ground conductor plate to a center side of the ground conductor plate.

BACKGROUND ART

Although sending/receiving vertically polarized waves have been the mainstream in conventional wireless communication, sending/receiving horizontally polarized waves have also recently become necessary, for example, in LTE (Long Term Evolution).

PRIOR ART DOCUMENT

Patent Literature

Patent Document 1: JP-2006-140667-A

SUMMARY OF INVENTION

Problem to be Solved

Whereas in an antenna device of Patent Document 1 a feeding point is located at a peripheral position on a substrate, antenna devices having a feeding point at a position that is distant from an outer periphery of a ground conductor plate to its center side have a problem that they can basically correspond only to polarized waves in a direction perpendicular to the ground conductor plate.

The present invention has been made in the above circumstances, and an object of the invention is to provide an antenna device that has a configuration in which a feeding point is located at a position that is distant from an outer periphery of a ground conductor plate to a center side and that would correspond to polarized waves in a direction parallel to the ground conductor plate.

Solution to Problem

One aspect of the present invention is an antenna device. The antenna device includes a ground conductor plate and an antenna element, the antenna element includes:

a first vertical portion and a second vertical portion which are erected substantially perpendicularly from the ground conductor plate; and a connecting portion which has a portion extending substantially parallel to the ground conductor plate and which connects one end of the first vertical portion and one end of the second vertical portion to each other, the other end of the first vertical portion serves as a feeding point and is located at a position that is distant from an outer periphery of the ground conductor plate to a center side of the ground conductor plate, the other end of the second vertical portion is grounded, and the connecting portion has an along-edge portion which extends along the outer periphery of the ground conductor plate when viewed from a direction perpendicular to the ground conductor plate.

A maximum voltage point of the antenna element may be located in the along-edge portion.

The along-edge portion may have a bent portion that is bent along a corner portion of the ground conductor plate when viewed from the direction perpendicular to the ground conductor plate.

The along-edge portion may be longer than or equal to a half of an entire length of the antenna element.

The feeding point may be located in a virtual area whose center is common to a center of the ground conductor plate and that is formed so as to have an area that is ½ of an area of the ground conductor plate by reducing the ground conductor plate by a same factor in longitudinal and lateral directions.

The other end of the second vertical portion may be connected to a portion in a vicinity of a peripheral edge of the ground conductor plate.

At least a part of the along-edge portion may be located at a position that is closer to the ground conductor plate than the one ends of the first vertical portion and the second vertical portion.

A desired combination of the above constituent elements and a method, a system, etc. obtained by converting an expression of the present invention are also effective as other aspects of the present invention.

Advantages of Invention

The present invention would provide an antenna device that has a configuration in which a feeding point is located at a position that is distant from an outer periphery of a ground conductor plate to a center side and that would corresponds to polarized waves in a direction parallel to the ground conductor plate.

DESCRIPTION OF EMBODIMENTS

Figure 1:
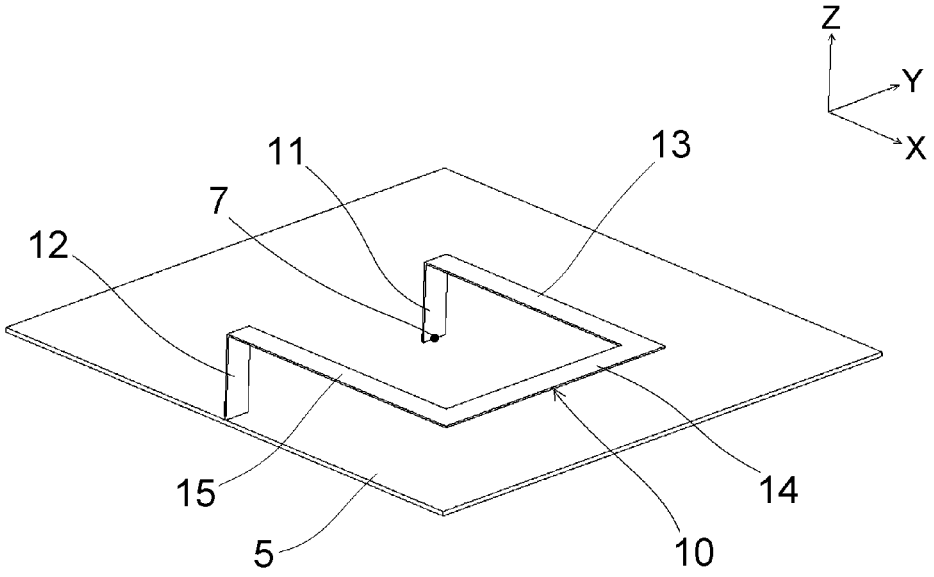
FIG. 1 is a schematic perspective view of an antenna device 1 according to a first embodiment of the present invention.

Preferred embodiments of the invention will be hereinafter described in detail with reference to the drawings. The same or equivalent constituent elements, members, or the like shown in the drawings are given the same symbol and redundant descriptions therefor will be omitted as appropriate. The embodiments are not intended to limit the invention and are just examples, and all features described in the embodiments and combinations thereof are not always essential to the invention.

Figure 2:
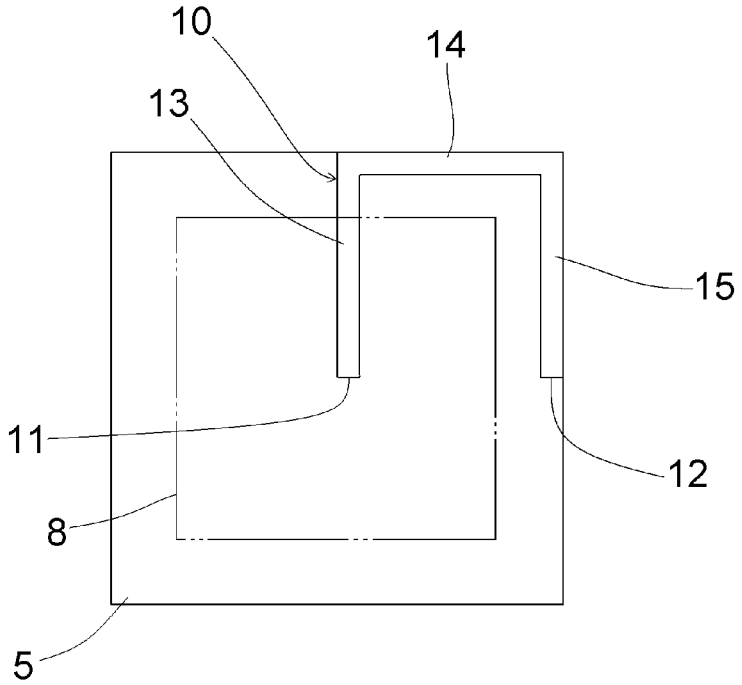
FIG. 2 is a schematic plan view of the antenna device 1.

FIG. 1 is a schematic perspective view of an antenna device 1 according to a first embodiment of the present invention. Three orthogonal axes, that is, X, Y, and Z axes, are defined as shown in FIG. 1. FIG. 2 is a schematic plan view of the antenna device 1. The antenna device 1 has sending/receiving target frequency ranges 699 to 960 MHz and 1,710 to 2,690 MHz. The antenna device 1 includes a ground conductor plate 5 and an antenna element 10. The ground conductor plate 5 is a flat plate that is parallel to the XY plane and functions as a ground of the antenna element 10. The ground conductor plate 5 may be a metal plate or a substrate on at least one of whose surfaces a ground pattern is formed. Each of sides of the ground conductor plate 5 is parallel to the X direction or the Y direction.

The antenna element 10 is made of a conductor and includes a first vertical portion 11, a second vertical portion 12, a first parallel portion 13, a second parallel portion 14, and a third parallel portion 15. The first vertical portion 11 and the second vertical portion 12 are erected substantially vertically (in the +Z direction) from the ground conductor plate 5. An end portion, in the −Z direction, of the first vertical portion 11 serves as a feeding point 7 and is located at a position that is distant from a periphery of the ground conductor plate 5 to a center side, for example, in a virtual area 8 (see FIG. 2) whose center is common to a center of the ground conductor plate 5 and whose area is ½ of an area of the ground conductor plate 5; that is, the virtual area 8 is formed by reducing the ground conductor plate 5 by the same factor ($1/\sqrt{2}$) in the longitudinal and lateral directions. An end portion, in the −Z direction, of the second vertical portion 12 is connected (grounded) to a portion in a vicinity of a peripheral edge of the ground conductor plate 5. The first vertical portion 11 and the second vertical portion 12 are located at the same position in the X direction.

The first parallel portion 13, the second parallel portion 14, and the third parallel portion 15 are substantially parallel to the ground conductor plate 5 and constitute a connecting portion that connects respective end portions, in the +Z direction, of the first vertical portion 11 and the second vertical portion 12 to each other. The first parallel portion 13 extends in the +X direction from the end portion, in the +Z direction, of the first vertical portion 11 and reaches a position where it shares the same X and Y coordinates with the outer periphery of the ground conductor plate 5. The second parallel portion 14 and the third parallel portion 15 constitute an along-edge portion that extends along the outer periphery of the ground conductor plate 5 when viewed from the +Z direction. The second parallel portion 14 extends in the −Y direction from an end portion, in the +X direction, of the first parallel portion 13 parallel to the outer periphery of the ground conductor plate 5 and reaches a position where it shares the same X and Y coordinates with a corner of the ground conductor plate 5. The third parallel portion 15 extends in the −X direction from an end portion, in the −Y direction, of the second parallel portion 14 parallel to the outer periphery of the ground conductor plate 5 and reaches the end portion, in the +Z direction, of the second vertical portion 12. A bent portion at the boundary between the second parallel portion 14 and the third parallel portion 15 is bent along the corner portion of the ground conductor plate 5 when viewed from the +Z direction. A portion around the center of the second parallel portion 14 is a maximum voltage point of the antenna element 10. A total length of the second parallel portion 14 and the third parallel portion 15 (the length of the along-edge portion) is greater than or equal to half of the entire length of the antenna element 10.

Figure 3:
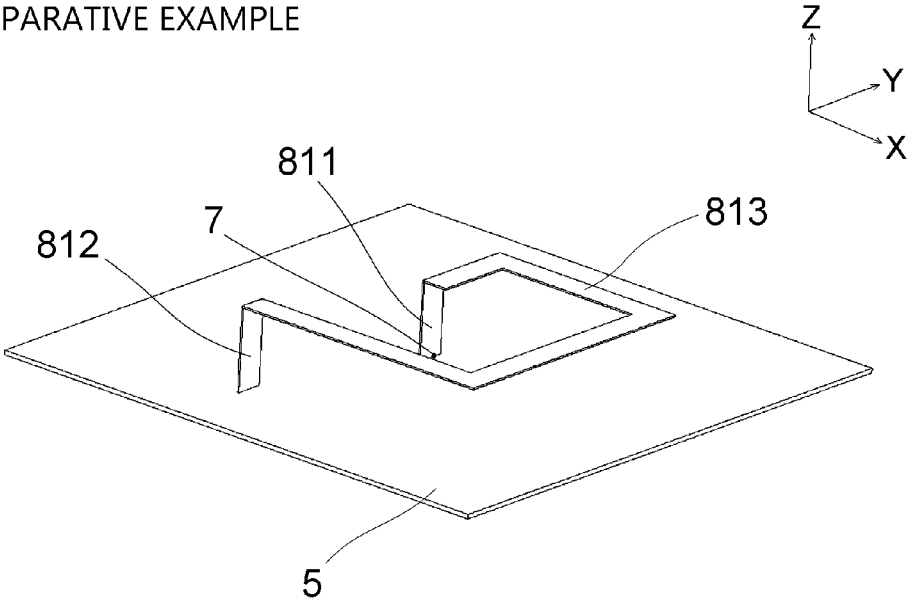
FIG. 3 is a schematic perspective view of an antenna device 800 of Comparative Example.
Figure 4:
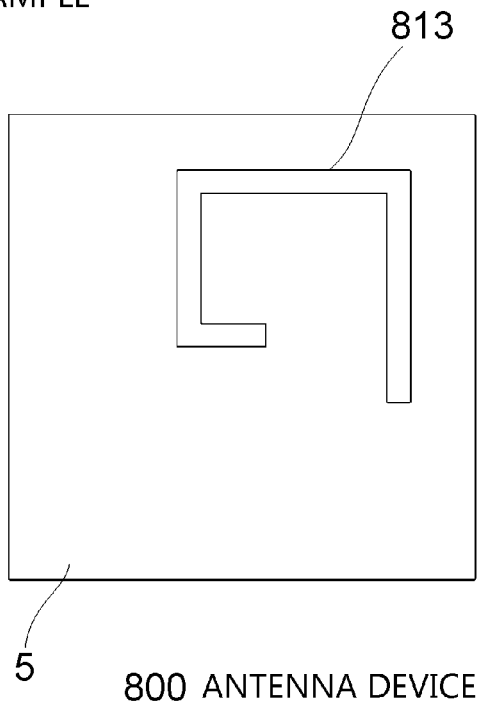
FIG. 4 is a schematic plan view of the antenna device 800.

FIG. 3 is a schematic perspective view of an antenna device 800 of Comparative Example. FIG. 4 is a schematic plan view of the antenna device 800. In the antenna device 800, as in the first embodiment, an end portion, in the −Z direction, of a first vertical portion 811 is located at the center of a ground conductor plate 5 and serves as a feeding point 7. On the other hand, unlike in the first embodiment, a parallel portion 813, parallel to the ground conductor plate 5, of the antenna element is located inside the outer periphery of the ground conductor plate 5 and does not have a portion that extends along the outer periphery of the ground conductor plate 5 when viewed from the +Z direction. An end portion (grounding portion), in the −Z direction, of a second vertical portion 812 is located at a position that is distant from the outer periphery of the ground conductor plate 5.

Figure 5:
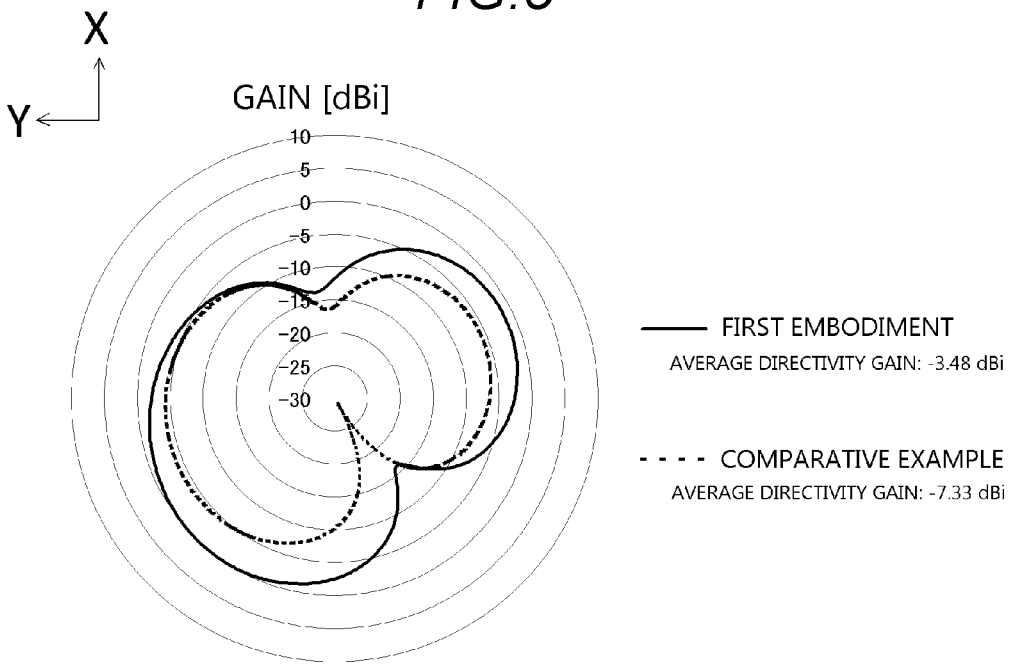
FIG. 5 is a diagram of respective directivity characteristics, at 800 MHz, in the XY plane, of polarized waves in a direction parallel to the XY plane of the antenna device 1 according to the first embodiment and the antenna device 800 of Comparative Example.

FIG. 5 is a diagram of respective directivity characteristics, at 800 MHz, in the XY plane, of polarized waves in a direction parallel to the XY plane of the antenna device 1 according to the first embodiment and the antenna device 800 of Comparative Example. As seen from FIG. 5, the directivity characteristic in the XY plane (i.e., the directivity characteristic in the directions parallel to the ground conductor plate 5) of the polarized waves in the direction parallel to the XY plane of the antenna device 1 according to the first embodiment is better than that of the antenna device 800 of Comparative Example in all directions. An average directivity gain in the XY plane is −3.48 dBi in the antenna device 1 according to the first embodiment and −7.33 dBi in the antenna device 800 of Comparative Example. The average directivity gain of the antenna device 1 according to the first embodiment is larger by about 3.8 dBi.

Figure 6:
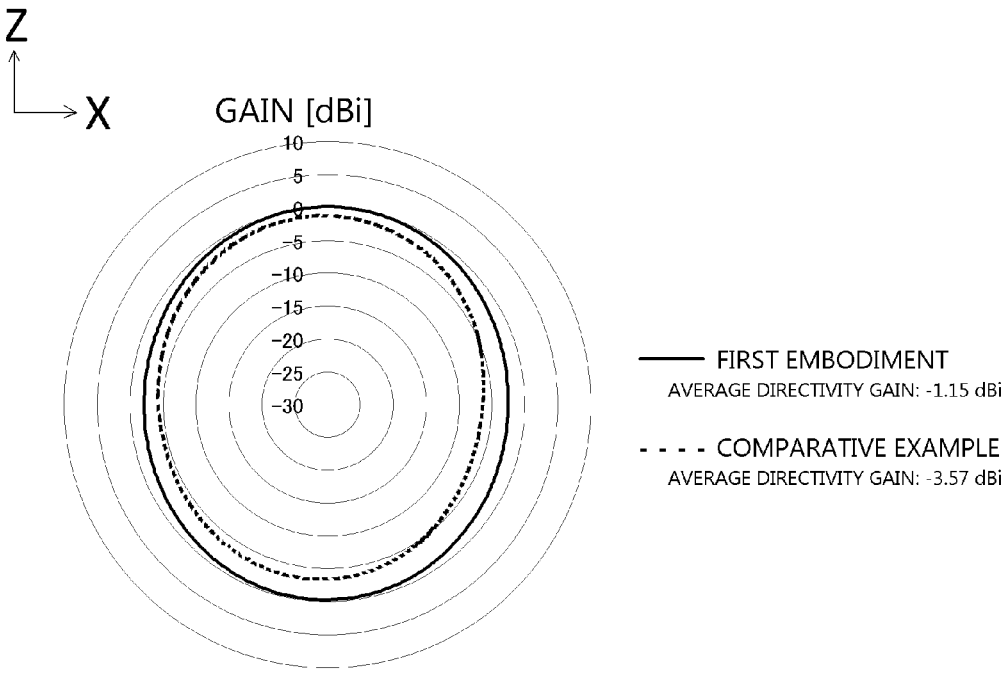
FIG. 6 is a diagram of respective directivity characteristics, at 800 MHz, in the XZ plane, of polarized waves in the direction parallel to the XY plane of the antenna device 1 according to the first embodiment and the antenna device 800 of Comparative Example.

FIG. 6 is a diagram of respective directivity characteristics, at 800 MHz, in the XZ plane, of the polarized waves in the direction parallel to the XY plane of the antenna device 1 according to the first embodiment and the antenna device 800 of Comparative Example. As seen from FIG. 6, the directivity characteristic in the XZ plane (i.e., the directivity characteristic in the directions perpendicular to the ground conductor plate 5) of the polarized waves in the direction parallel to the XY plane of the antenna device 1 according to the first embodiment is better than that of the antenna device 800 of Comparative Example in all directions. An average directivity gain in the XZ plane is −1.15 dBi in the antenna device 1 according to the first embodiment and −3.57 dBi in the antenna device 800 of Comparative Example. The average directivity gain of the antenna device 1 according to the first embodiment is larger by about 2.4 dBi.

The embodiment would provide the following advantages.

(1) Since the second parallel portion 14 and the third parallel portion 15 of the antenna element 10 extend along the outer periphery of the ground conductor plate 5 when viewed from the direction perpendicular to the ground conductor plate 5, it is possible to correspond to the polarized waves in the direction parallel to the ground conductor plate 5 (i.e., to increase the directivity gain of the polarized waves in the direction parallel to the ground conductor plate 5) though the antenna element 10 is configured in such a manner that the feeding point 7, that is, the end portion, in the −Z direction, of the first vertical portion 11, is distant from the outer periphery to the center side (e.g., the feeding point 7 is located around the center of the ground conductor plate 5).

(2) Since the maximum voltage point of the antenna element 10 is located at a position along the outer periphery of the ground conductor plate 5 when viewed from the direction perpendicular to the ground conductor plate 5, an effect of increasing the directivity gain of the polarized waves in the direction parallel to the ground conductor plate 5 is large.

(3) Since the bent portion at the boundary between the second parallel portion 14 and the third parallel portion 15 of the antenna element 10 is bent along the corner portion of the ground conductor plate 5 when viewed from the +Z direction, an effect of increasing the directivity gain of the polarized waves in the direction parallel to the ground conductor plate 5 is large.

(4) Since the end portion, in the −Z direction, of the second vertical portion 12 of the antenna element 10 is connected (grounded) to the portion in the vicinity of the peripheral edge of the ground conductor plate 5, an effect of increasing the directivity gain of the polarized waves in the direction parallel to the ground conductor plate 5 is large.

Figure 7:
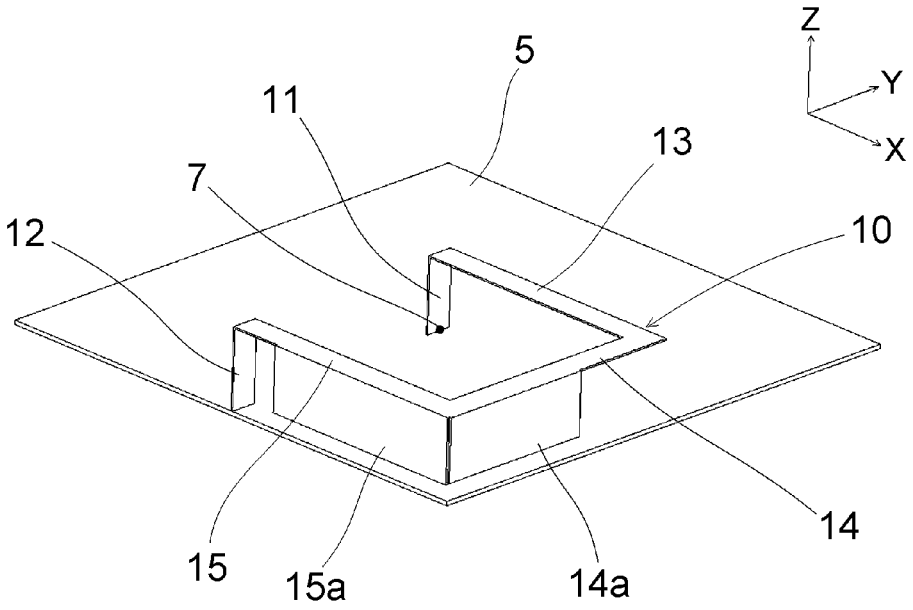
FIG. 7 is a schematic perspective view of an antenna device 2 according to a second embodiment of the present invention.
Figure 8:
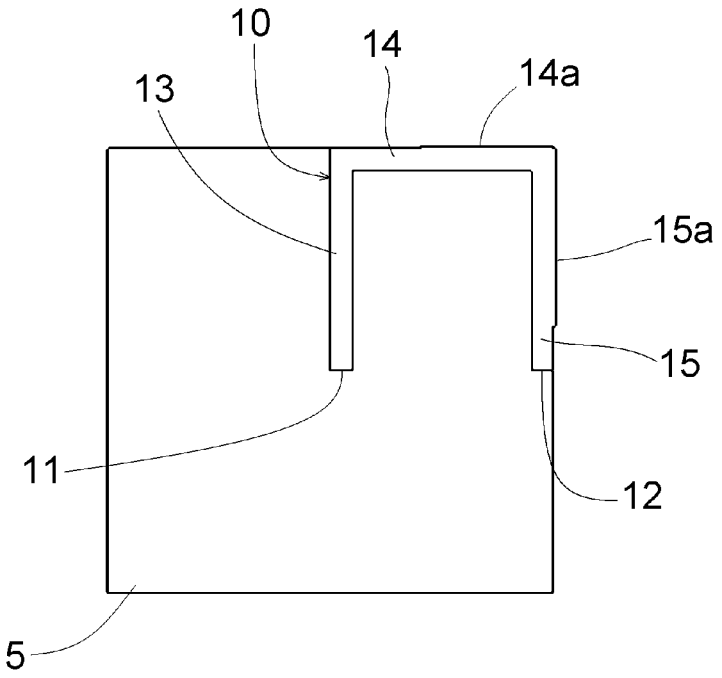
FIG. 8 is a schematic plan view of the antenna device 2.

FIG. 7 is a schematic perspective view of an antenna device 2 according to a second embodiment of the invention. FIG. 8 is a schematic plan view of the antenna device 2. The antenna device 2 according to the embodiment is different from the antenna device 1 according to the first embodiment in that tongue pieces 14*a* and 15*a* project from the second parallel portion 14 and the third parallel portion 15, respectively, and is the same as the antenna device 1 according to the first embodiment in the other points. The tongue piece 14*a* projects in the −Z direction (i.e., toward the ground conductor plate 5) from an outer peripheral edge that is located on the +X direction and extends in a range having a predetermined length and including the end, in the −Y direction, of the second parallel portion 14, and is not in contact with the ground conductor plate 5. The tongue piece 15*a* projects in the −Z direction (i.e., toward the ground conductor plate 5) from an outer peripheral edge that is located on the −Y direction and extends in a range having a predetermined length and including the end, in the +X direction, of the third parallel portion 15, and is not in contact with the ground conductor plate 5. The side, on the −Y direction, of the tongue piece 14*a* and the side, on the +X direction, of the tongue piece 15*a* may be in contact with or may be separate from each other. According to the embodiment, by virtue of the formation of the tongue pieces 14*a* and 15*a*, the directivity gain of polarized waves in the direction parallel to the ground conductor plate 5 would be increased further.

Although the present invention has been described above by way of the embodiments, it would be understood by those skilled in the art that each constituent element and treatment or working process of the embodiments would be modified in various manners within a scope of the claims.

DESCRIPTION OF SYMBOLS

1, 2: Antenna device; 5: Ground conductor plate; 7: Feeding point; 8: Virtual area; 10: Antenna element; 11: First vertical portion; 12: Second vertical portion; 13: First parallel portion; 14: Second parallel portion; 14*a*: Tongue portion; 15: Third parallel portion; 15*a*: Tongue portion; 800: Antenna device; 811: First vertical portion; 812: Second vertical portion; 813: Parallel portion.

The invention claimed is:

1. An antenna device comprising:

a ground conductor plate; and an antenna element, wherein the antenna element includes:

a first vertical portion and a second vertical portion which are erected substantially perpendicularly from the ground conductor plate, and a connecting portion which includes a portion extending substantially parallel to the ground conductor plate and which connects one end of the first vertical portion and one end of the second vertical portion to each other, wherein the other end of the first vertical portion serves as a feeding point and is located at a position that is distant from an outer periphery of the ground conductor plate to a center side of the ground conductor plate, wherein the other end of the second vertical portion is grounded, wherein the connecting portion includes an along-edge portion which extends along the outer periphery of the ground conductor plate when viewed from a direction perpendicular to the ground conductor plate, and wherein a part of the along-edge portion extends from the outer periphery of the ground conductor plate toward the center side of the ground conductor plate.

2. The antenna device according to claim 1, wherein a maximum voltage point of the antenna element is located in the along-edge portion.

3. The antenna device according to claim 2, wherein the along-edge portion includes a bent portion that is bent along a corner portion of the ground conductor plate when viewed from the direction perpendicular to the ground conductor plate.

4. The antenna device according to claim 3, wherein the along-edge portion is longer than or equal to a half of an entire length of the antenna element.

5. The antenna device according to claim 2, wherein the along-edge portion is longer than or equal to a half of an entire length of the antenna element.

6. The antenna device according to claim 1, wherein the along-edge portion includes a bent portion that is bent along a corner portion of the ground conductor plate when viewed from the direction perpendicular to the ground conductor plate.

7. The antenna device according to claim 6, wherein the along-edge portion is longer than or equal to a half of an entire length of the antenna element.

8. The antenna device according to claim 1, wherein the along-edge portion is longer than or equal to a half of an entire length of the antenna element.

9. The antenna device according to claim 1, wherein the feeding point is located within a virtual area whose center is common to a center of the ground conductor plate and which is formed so as to have an area that is ½ of an area of the ground conductor plate by reducing the ground conductor plate by a same factor in longitudinal and lateral directions.

10. The antenna device according to claim 1, wherein the other end of the second vertical portion is connected to a portion in a vicinity of a peripheral edge of the ground conductor plate.

11. The antenna device according to claim 1, wherein at least a part of the along-edge portion is located at a position that is closer to the ground conductor plate than the one end of the first vertical portion and the one end of the second vertical portion.

12. An antenna device comprising:

a ground conductor plate; and an antenna element, wherein the antenna element includes:

a first vertical portion and a second vertical portion which are erected substantially perpendicularly from the ground conductor plate, and a connecting portion which includes a portion extending substantially parallel to the ground conductor plate and which connects one end of the first vertical portion and one end of the second vertical portion to each other, wherein the other end of the first vertical portion serves as a feeding point and is located at a position that is distant from an outer periphery of the ground conductor plate to a center side of the ground conductor plate, wherein the other end of the second vertical portion is grounded, wherein the connecting portion includes an along-edge portion which extends along the outer periphery of the ground conductor plate when viewed from a direction perpendicular to the ground conductor plate, and wherein the feeding point is located within a virtual area whose center is common to a center of the ground conductor plate and which is formed so as to have an area that is ½ of an area of the ground conductor plate by reducing the ground conductor plate by a same factor in longitudinal and lateral directions.

13. An antenna device comprising:

a ground conductor plate; and an antenna element, wherein the antenna element includes:

a first vertical portion and a second vertical portion which are erected substantially perpendicularly from the ground conductor plate, and a connecting portion which includes a portion extending substantially parallel to the ground conductor plate and which connects one end of the first vertical portion and one end of the second vertical portion to each other, wherein the other end of the first vertical portion serves as a feeding point and is located at a position that is distant from an outer periphery of the ground conductor plate to a center side of the ground conductor plate, wherein the other end of the second vertical portion is grounded, wherein the connecting portion includes an along-edge portion which extends along the outer periphery of the ground conductor plate when viewed from a direction perpendicular to the ground conductor plate, and wherein at least a part of the along-edge portion is located at a position that is closer to the ground conductor plate than the one end of the first vertical portion and the one end of the second vertical portion.

14. The antenna device according to claim 13, wherein a maximum voltage point of the antenna element is located in the along-edge portion.

15. The antenna device according to claim 13, wherein the along-edge portion includes a bent portion that is bent along a corner portion of the ground conductor plate when viewed from the direction perpendicular to the ground conductor plate.

16. The antenna device according to claim 13, wherein the along-edge portion is longer than or equal to a half of an entire length of the antenna element.

17. The antenna device according to claim 13, wherein the feeding point is located within a virtual area whose center is common to a center of the ground conductor plate and which is formed so as to have an area that is ½ of an area of the ground conductor plate by reducing the ground conductor plate by a same factor in longitudinal and lateral directions.

18. The antenna device according to claim 13, wherein the other end of the second vertical portion is connected to a portion in a vicinity of a peripheral edge of the ground conductor plate.

* * * * *